US005783528A

United States Patent [19]

Rodenberg

[11] Patent Number: 5,783,528

[45] Date of Patent: Jul. 21, 1998

[54] SYNTHETIC LUBRICANT BASED ON ENHANCED PERFORMANCE OF SYNTHETIC ESTER FLUIDS

[75] Inventor: Douglas Rodenberg, Sharonville, Ohio

[73] Assignee: Diversey Lever, Inc., Plymouth, Mich.

[21] Appl. No.: 779,532

[22] Filed: Jan. 7, 1997

[51] Int. Cl.[6] ..... C10M 169/04

[52] U.S. Cl. ..... 508/200; 508/287; 508/463; 508/485; 508/501

[58] Field of Search ..... 508/485, 463, 508/501, 200, 287

[56] References Cited

U.S. PATENT DOCUMENTS

| | | | |
|---|---|---|---|
| 2,087,585 | 7/1937 | Sweeney et al. | 87/9 |
| 2,121,976 | 6/1938 | Mikeska et al. | 87/9 |
| 2,138,809 | 11/1938 | Reiff et al. | 260/475 |
| 2,173,117 | 9/1939 | Johnson | 87/9 |
| 2,192,976 | 3/1940 | Kraus | 87/0.9 |
| 2,250,265 | 7/1941 | Kapp | 252/11 |
| 2,316,754 | 4/1943 | Backoff et al. | 44/582 |
| 2,411,150 | 11/1946 | Evans | 252/56 |
| 2,628,239 | 2/1953 | Ladd | 260/396 |
| 2,691,634 | 10/1954 | Benoit | 252/52 |
| 2,826,549 | 3/1958 | Manfeuffel | 252/42.1 |
| 2,891,089 | 6/1959 | Jolly | 260/468 |
| 2,895,914 | 7/1959 | Kern et al. | 252/37 |
| 3,413,223 | 11/1968 | Forbes | 252/37 |
| 3,761,405 | 9/1973 | Jervis | 252/51.5 |
| 3,939,083 | 2/1976 | Coppock et al. | 252/42 |
| 4,147,641 | 4/1979 | Machleder et al. | 252/51.5 |
| 4,175,046 | 11/1979 | Coant et al. | 252/56.5 |
| 4,379,065 | 4/1983 | Lange | 252/51.5 |
| 4,490,266 | 12/1984 | Hentschel et al. | 252/49.8 |
| 4,715,973 | 12/1987 | de Jong et al. | 252/40.5 |
| 4,737,297 | 4/1988 | Yoshida et al. | 252/9 |
| 4,777,307 | 10/1988 | Alward et al. | 585/2 |
| 4,778,611 | 10/1988 | Bishop | 252/37.2 |
| 4,832,860 | 5/1989 | Katafuchi et al. | 508/496 |
| 4,892,680 | 1/1990 | Ishida | 252/565 |
| 4,929,372 | 5/1990 | Akanuma et al. | 508/485 |
| 4,956,122 | 9/1990 | Watts | 252/565 |
| 5,064,546 | 11/1991 | Dasai | 252/56 |
| 5,136,116 | 8/1992 | Ohhazama et al. | 585/6.6 |
| 5,236,610 | 8/1993 | Perez et al. | 252/56 |
| 5,407,601 | 4/1995 | Furey et al. | 252/51.5 |
| 5,512,198 | 4/1996 | Sasaki et al. | 252/68 |

FOREIGN PATENT DOCUMENTS

| | | |
|---|---|---|
| 0240814 | 3/1987 | European Pat. Off. . |
| 2292395 | 5/1989 | Japan . |
| 1204995 | 8/1989 | Japan . |
| HEI 2286780 | 11/1990 | Japan . |
| 4018491 | 1/1992 | Japan . |
| 4136096 | 5/1992 | Japan . |
| 2134538 | 1/1983 | United Kingdom . |

*Primary Examiner*—Jacqueline V. Howard
*Attorney, Agent, or Firm*—A. Kate Huffman

[57] ABSTRACT

An improved lubricant is provided by combining ester lubricants with alkylated polyaromatic lubricants. This combination provides a lubricant that exhibits the oxidation/varnish control of alkylated naphthenics, while at the same time providing the high temperature stability of the ester-type lubricants. A wide variety of ester lubricants can be used such as polyol esters, dimeracid esters and the like. Preferably, the alkylated aromatic lubricant has a viscosity greater than 25 up to 220 cSt measured at 40° C. Greases can also be formed using this combination.

17 Claims, No Drawings

SYNTHETIC LUBRICANT BASED ON ENHANCED PERFORMANCE OF SYNTHETIC ESTER FLUIDS

BACKGROUND OF THE INVENTION

Synthetic ester lubricants are utilized in a wide variety of different applications including air compressors, bearings, turbines, hydraulics, gears, high-temperature chains, and greases. The synthetic esters find such wide-ranging applications because of their oxidation stability, lubricity, low volatility, high and low temperature performance, and varnish/deposit control. Oxidation stability and related varnish/deposit control are very important for most applications, and are essential for a good, general purpose, long-life synthetic lubricant.

For compressor applications, oxidation stability and related varnish/deposit control are essential for maximizing the life of the lubricant. For hydraulic applications, oxidation life and related varnish/deposit control is also very important. However, water separation, seal compatibility, and flash points are frequently more important. For jet turbine applications, oxidation life is very important. However, excellent extreme temperature performance is necessary. For high temperature chains, oxidation life and related varnish/deposit control are very important. However, again, thermal stability and low volatility become very important.

Overall, synthetic esters offer excellent lubrication life and related varnish/deposit control.

The utility of synthetic esters, however, could be significantly improved by increasing the oxidation life of the lubricant, reducing the acid-forming tendency of a lubricant, reducing the volatility of the lubricant, and in particular reducing the varnish and deposit formation of the esters. By improving these characteristics, the synthetic ester lubricants can be utilized in even more applications and provide greater useful life for the lubricant.

There are various references that disclose combinations of alkylated benzene lubricants and synthetic esters. Primarily in these applications, one of the lubricants is added simply to provide for dissolution of certain additives and is not useful for any application requiring temperature stability, low volatility, and excellent anti-oxidation. For example, Japanese Kokai 4-136096 and Japanese Kokai 4-18491 disclose combinations of esters with alkylated benzene for use in refrigeration applications. In these applications, the alkylated benzene is added to the ester to improve compatibility with the refrigerant gas. The alkylated aromatic is added to improve anti-wear properties and to lower the hygroscopic properties of the ester lubricant in the presence of the refrigerant gas. In refrigeration applications, however, the viscosity of the alkylated benzene must be relatively low—generally less than 20 cSt, and accordingly the composition is limited to alkyl monoaromatic compositions. Certain blends are also used to ensure that additives are properly in solution, as disclosed in Japanese Kokai 2-292395. In this application, minor amounts (10 to 20% of an ester-type synthetic lubricant or an ether-type synthetic lubricant or combination thereof) are used to ensure that 1-naphtol is maintained in solution. This can then be combined with a wide variety of different lubricants. The 1-naphthol is added to the lubricant to improve oxidation stability.

Likewise, Perez U.S. Pat. No. 5,236,610 discloses an antioxidant additive for an engine or propulsion system lubricant which is dissolved in a carboxylic acid tetraester.

This is then combined with a lubricant blend which can be a polyol ester, a phosphate ester and a polyalphaolefin or an alkylated naphthalene. In this application, the alkylated naphthalene is specifically described as one having a viscosity of 5–25 cSt at 40° C. Although such an alkylated naphthalene may be good for maintaining the antioxidant in solution, it is virtually inoperative for higher temperature applications intended in the patent, as it would immediately flash off at the intended operating temperatures of 375° to 400° C. Thus, none of the known prior art references teach the incorporation of an ester-type lubricant with an alkylated aromatic for the purpose of improving the overall lubricating characteristics of the lubricant. Such prior art combinations are generally for the purpose of maintaining additives in solution.

SUMMARY OF THE INVENTION

The present invention is premised upon the realization that the performance characteristics of synthetic ester lubricants can be significantly improved by blending the synthetic ester lubricant with an effective amount of a aromatic lubricant such as an alkyl aromatic lubricant or an alkoxyaromatic lubricant. This blend increases the oxidation life of a synthetic ester lubricant and reduces acid-forming and varnish tendencies of the esters during oxidation. Further, this improves the viscosity control of the esters during oxidation, and reduces the volatility of the esters, particularly at high temperatures. Further, this reduces the corrosiveness of the oxidized ester-based lubricant.

More particularly, these characteristics are achieved by blending an alky- or alkoxyaromatic lubricant having a viscosity of at least about 29 cSt at 40° C. with ester lubricants, significantly improving the overall performance of the synthetic ester lubricants.

The objects and advantages of the present invention will be further appreciated in light of the following detailed description.

DETAILED DESCRIPTION

The present invention comprises a major portion of an ester lubricant blended with an aromatic lubricant, either an alkyl polyaromatic or an alkoxy polyaromatic lubricant. This blend significantly enhances the performance characteristics of the lubricant.

The present invention will generally include from 30% up to 95 weight percent, preferably at least 50%, of the ester lubricant, with the remainder being the aromatic lubricant and any lubricant additives. The esters can be any ester lubricant, either natural or synthetic. The natural esters are normally only used in biodegradable lubricant applications due to their limited oxidation stability. Synthetic esters can be used competitively in most lubricant applications including biodegradable lubricant applications. The choice of the synthetic ester depends on the required performance specifications and cost.

Natural esters normally include seed oils, which can be blended with additives to provide marginal to acceptable performance in lubricant applications where biodegradability and lower cost is preferred. High oleic sunflower and rape seed oils offer the best overall performance based on viscosity, pour point, flash point, volatility, oxidation resistance, and response to additives. These products are sold by SVO Enterprises, a business unit of Lubrizol Corporation, under the trade names Sunyl 80, Sunyl 90, and Sunyl RS-80. They can be blended with pour point depressants, natural wax esters, telomerized vegetable oil thickeners, and synthetic esters such as glycerol esters and TMP trioleate to enhance their physical properties and lubrication performances. Such a product is sold by SVO Enterprises under the trade name Sunyl PF 331. This offers improved performance over straight seed oil on pour point, low temperature Brookfield viscosity, oxidation stability, water demulsibility, foam control, and thermal stability.

Preferably, the ester lubricant of the present invention will be a synthetic ester lubricant. The type of ester depends upon the physical and performance properties required by the lubricant. Typical synthetic esters include diesters, polyolesters, "complex" polyolesters, aromatic esters, and dimeresters. Common lubricant diesters include adipate, azelate esters of C5 to C18 straight or branched alcohols. Common lubricant-grade polyolesters include trimethylol propane (TMP), pentaerythritol (PE), dipentaerythritol (di-PE), and tripentaerythritol (tri-PE), and neopentylglycol esters (NPG) of C3 to C22 straight or branched fatty acids. Further, these polyol alcohols can be complexed with diacids such as adipic or azelaic acids and then further esterized with C3 to C1 8 straight or branched alcohols to form "complex" polyolesters.

Common lubricant-grade aromatic esters such as phthalate esters and trimellitate esters can be formed by reacting their anhydrides with C3 to C18 straight and branched alcohols. Common lubricant-grade dimeresters include C36 dimer diacids esterified with C3 to C22 straight and branched alcohols. Further, dimer diacids can be esterified by reacting with neopentyl glycol and then C3 to C22 fatty acids to form a complex dimerester. Synthetic ester lubricants particularly suitable for use in the present invention include Emery 2971, Emery 2918, Emery 2913, Emery 2935, Mobil 1186B and Mobil 1264.

In addition to the synthetic or natural ester, the lubricant of the present invention will also include from about 1 to about 70% of an aromatic lubricant. The polyaromatic lubricant is specifically an alkylated polyaromatic or alkoxylated polyaromatic lubricant.

For purposes of the present invention, the aromatic portion of the aromatic lubricant can be a naphthyl group or a fused aromatic compound such as a bis-phenyl or phenanthrene group. Preferably, the aromatic group is a naphthalene.

The aromatic moiety is substituted with one or more alkyl or alkoxy groups (including polyalkoxy groups). Specifically, the aromatic group can be substituted with at least one alkyl group which is C3 alkyl or higher, generally C5 to C22. The aromatic group can be substituted with an alkyl group to form, for example, an alkyl naphthalene wherein the alkyl portion of the alkyl group is C3 to C22. The method of manufacturing such compositions is relatively well known but is disclosed in particular in U.S. Pat. No. 5,191,135, U.S. Pat. No. 5,177,284, U.S. Pat. No. 5,191,134, and U.S. Pat. No. 5,043,508.

Generally, for use in the present invention, the alkylated aromatic composition will be an effective lubricant and will have a viscosity of at least about 29–220 cSt at 40° C. A lower viscosity alkylated naphthalene can be used to improve antioxidation, varnish/deposit control, and low temperature performance of the ester lubricant when required, even though it is more volatile. Such low-viscosity lubricants are more volatile, but tend to produce fewer deposits when the ester blend becomes oxidized, hydrolyzed, and/or thermally degraded. One preferred alkylated aromatic is a monoalkylated naphthalene (C18) which has a viscosity of 29 cSt at 40° C. Mobil Chemical Co. sells such an alkylated naphthalene under the trademark Mobil MCP917. Di and tri alkylated naphthalenes and mixtures are also available and can be used. Mobil Chemical Co. sells such a dialkylated naphthalene under the trademark Mobil MCP968.

Although viscosity requirements of the alkylated aromatic lubricant will vary depending upon the particular application, in all high temperature applications the viscosity should be above about 29 cSt at 40° C. For example, high temperature applications, particularly chain lubricants, are used at temperatures of 350° F. up to 600° F. For lubricating moving parts, which are heated to 550°–70° F. or more, the aromatic lubricant should preferably have a viscosity range of from about 75 to 220 cSt at 40° C. Mobil 968, has a viscosity of 115 cSt at 40° C. and therefore would be acceptable for use in this application.

Compressors, hydraulics, gears and bearings do not normally operate at high temperatures. Oxidation stability is the top priority. All around good performance is required, so the base stocks must be well balanced to perform under various conditions: low temperatures, moderately high temperatures, and oxidative conditions. These can accept lower alkylated aromatic viscosities with a lower viscosity of about 29 to about 115 cSt acceptable for these applications. Aromatic lubricants less than 29 cSt would perform well for enhanced oxidation stability, but would be too volatile for most applications except low viscosity spindle oils. Such lubricants having alkylated aromatics with a viscosity greater than 115 cSt would not provide the enhanced oxidation stability. Preferably, for these applications a viscosity of 29 to 75 cSt at 40° C. would be preferred. The lubricant of the present invention is not particularly suitable for refrigerant applications. Therefore, it should be used in the substantially complete absence of refrigerants.

For turbines, all around low- and high-temperature performance is critical. Also, oxidation stability, varnish control, and corrosion inhibition are premium performance requirements. These should have a viscosity of 20 to 40 cSt, with 25 to 35 cSt offering maximum performance.

For biodegradable lubricants, generally the viscosity of the aromatic lubricant should be around 29 to 220 cSt, depending on the viscosity requirements of the lubricant.

With respect to greases, a wide range of alkylated aromatic viscosities can be used, again depending upon the application, generally, from 29 to 220 cSt at 40° C.

The alkylated aromatic composition will be from about 1% to 70% by weight of the lubricant composition of the present invention and preferably about 5% to 50%, more preferably 5 to 40%, by weight.

In addition to the alkylated aromatic compounds and the esters, the present invention can incorporate the following additives in well known standard amounts: anti-wear/extreme pressure additives, antioxidants, metal deactivators, detergents, dispersants, corrosion inhibitors, defoamers, dyes or such additives as may be required for the lubricant application. The lubricant of the present invention can also include 1% to 20% of various components which may affect various physical characteristics of the lubricant such as viscosity, viscosity index, solvency, and low temperature characteristics and the like. Such components would include polyalphaolefins, polyalkylene glycols, silicone lubricating fluids, as well as modified or grafted versions such as esters grafted onto polyalphaolefins. Other polymer fluids which are typically used in the manufacturing of lubricants can also be incorporated such as polyisobutylene, polybutylene, olefinic copolymers, styrene and styrene copolymers, branched paraffinic polymers and polymethacrylates. These are all components that are well known for use with motor oils and industrial lubricants.

One combination of additives has been found to substantially improve the high temperature characteristics of the lubricant. The addition of an oligomerized alkyl dihydroquinoline with a polyalkylene succinimide and optionally a borate significantly improves the overall characteristics of the lubricant. This combination decreases varnish formation. The varnish which does form is generally soft. Upon further oxidation, the varnish turns to a soft graphite-like powder.

Generally, the alkyl dihydroquinoline will be a trialkyl (trimethyl) dihydroquinoline such as 1,2-dihydro-2,2,4-trimethylquinoline. The polyalkylene succinimide can be, for example, a polyisobutylene reacted with a succinic anhydride, in turn reacted with an amine to form the succinimide. Chevron Chemical sells a succinimide as well as a blend of potassium borate with polyisobutylene succinimide sold under the trademark OLOA 9750.

Generally, the formulation will include about 2% of the polyalkylene succinimide and about 2% of the alkyl dihydroquinoline and about 0.5% of the borate by weight.

The lubricant of the present invention is formed by simply adding the base fluid and additive components together in a blender and mixing until completely solubilized. Due to their nature, they will remain solubilized without further mixing or treatment.

The lubricant of the present invention can further be formulated into a grease by adding appropriate thickeners in the amount of 6 to 14% depending on the thickener and the desired amount of thickening. The ratio of aromatic lubricant and ester lubricant should remain substantially the same with simply the addition of thickener. Typical thickeners include polyurea, modified clays, soap thickeners such as calcium complex, calcium sulfonate, lithium, lithium complex, and aluminum complex. The grease lubricant of the present invention can be used in a wide variety of applications including general lubrication and in any application where grease is employed.

The present invention will be further appreciated in light of the following detailed examples.

EXAMPLE 1

In order to test the formulations of the present invention in high temperature chain lubricant applications, two lubricants having the following specific components were prepared:

| Additive | Weight % No. 1 | Weight % No. 2 |
|---|---|---|
| Emery 2913 (Henkel Corp/Emergy Group) | 65.40 | |
| Emery 2918 (Henkel Corp/Emery Group) | | 65.40 |
| Mobil MCP 968 (Mobil Chemical Co.) | 30.00 | 30.00 |
| Irgamet 39 (Ciba Geigy) | 0.10 | 0.10 |
| OLOA 9750 (Chevron Chemicals)[1] | 2.00 | 2.00 |
| Vanlube RD (RT Vanderbilt)[2] | 2.00 | 2.00 |
| Duraphos 524 (Albright & Wilson)[3] | 0.50 | 0.50 |
| | 100.00 | 100.00 |

| Example 1 | | No. 1 | No. 2 |
|---|---|---|---|
| Petri Dish - Volatility (% Weight Loss @ 24 hrs. @ 450° F.) | With Mobil MCP 968 | 6.71% | 4.30% |
| Petri Dish - Volatility (% Weight Loss @ 24 hrs. @ 450° F.) | Without MCP 968 (100% ester) | 9.40% | 5.91% |
| Petri Dish - Varnish (96 hours @ 450° F.) | With Mobil MCP 968 | Soft Sludge | Soft Sludge |
| | Without MCP 968 (100% ester) | Hard Plastic | Hard Plastic |
| Bicycle Chain (24 hrs. & 450° F.) | With Mobil MCP 968 | Light varnish with some soft deposits. Loose links. | Light varnish with some soft deposits. Loose links. |
| | Without MCP 968 (100% ester) | Heavy varnish with hard deposits. Stiff/frozen links. | Heavy varnish with hard deposits. Stiff/frozen links. |

[1]Borate lubricant oil.
[2]Polymerized 1,2-dihydro-2,2,3-trimethylquinoline.

In both formulas, volatility of the ester and MCP968 blends is less than the volatility of the individual esters when they are all compounded with the same additives. Further, the varnish produced by the ester and MCP968 blends is less than the varnish produced by the individual esters when they are all compounded with the same additives. Further, not only is the amount of varnish reduced by the addition of Mobil MCP 968, but it is softer, which results in less binding in chains. Bicycle chains lubricated with the formulas containing Mobil MCP 968 were very clean and did not bind after heating at 450° F. for 24 hours. Most esters produce a very sticky to hard plastic residue which binds chain links and contributes to the accumulation of carbonized deposits.

EXAMPLE 2

In order to test the formulations of the present invention in air compressor, hydraulic, gear, and bearing lubricant applications, two lubricants having the following specific components were prepared:

| Additive | No. 1 | No. 2 |
|---|---|---|
| Emery 2971 (Henkel Corp/Emergy Group) | 77.3 | |
| Emery 2995 (Henkel Corp/Emery Group) | | 78.0 |
| Mobil MCP 917 (Mobil Chemicol Co.) | 20.00 | 20.00 |
| Irgolube 349 (Ciba Geigy) | | 0.30 |
| Duraphos 524 (Albright & Wilson) | 1.00 | |
| Lubrizol 859 (Lubrizol Corp.) | 0.10 | 0.10 |
| Irgamet 39 (Ciba Geigy) | 0.10 | 0.10 |
| Irganox L-57 (Ciba Geigy) | 1.00 | 1.00 |
| Irganox L-135 (Ciba Geigy) | 0.50 | 0.50 |

| Example 2 | No. 1 | No. 2 |
|---|---|---|
| RBOT with Mobil MCP 917: | | |
| Hours | 30 hrs. @ 275° F. | 30 hrs. @ 275° F. |
| TAN | 3.03 | 11.30 |
| Oil Appearance | Dark amber oil | Block oil |
| Copper Appearance | Very clean copper | Clean copper |
| Varnish and Sludge | Light sludge | Light sludge |
| RBOT Without MCP 917 | | |
| Hours | 30 hrs. @ 275° F. | 30 hrs. @ 275° F. |
| TAN | 4.86 | 3425 |
| Oil Appearance | Black oil | Black oil |
| Copper 1 | Clean copper | Clean copper |
| Varnish and Sludge: | Light sludge | Light sludge |

In this example, oil color, copper corrosion, varnish/deposits, and acidity are reduced, as determined by the rotary bomb oxidation test, by the addition of Mobil MCP 917.

EXAMPLE 3

In order to test the formulations of the present invention in turbines, one lubricant having the following specific components was prepared:

| Additive | Weight % |
|---|---|
| Emery 2935 (Henkel Corp./Emery Group) | 77.3 |
| Mobil MCP 917 (Mobil Chemical Co.) | 20.00 |
| Duraphos 524 (Albright & Wilson) | 1.00 |
| Lubrizol 859 (Lubrizol (orp.) | 0.10 |
| Irgamet 39 (Ciba Geigy) | 0.10 |
| Irganox L-57 (Ciba Geigy) | 1.00 |
| Irganox L-135 (Ciba Geigy) | 0.50 |
| | 100.00 |

| Example 3 | No. 1 | Mobil Jet Oil 254 | Shell Aero-shell 560 |
|---|---|---|---|
| RBOT w. Mobil MCP 917: | | | |
| Hours | 20 hrs. @ 150° C. | | |
| TAN | 126 | | |
| Oil Appearance | Dark amber oil | | |
| Copper Appearance | Very clean copper | | |
| Varnish and Sludge | Light sludge | | |
| RBOT Without MCP 917 | | | |
| Hours | 19 hrs. @ 150° C. | 17 hrs. @ 150° C. | 19 hrs. @ 150° C. |
| TAN | 152 | 133 | 80.14 |
| Oil Appearance | Dark brown | Dark black thick oil | Dark black oil |
| Copper Appearance | Clean copper | Clean copper | Clean copper |
| Varnish and Sludge: | Slight sludge/ varnish | Moderate varnish | Moderate varnish |

In this example, oil color, copper corrosion, varnish/deposits, and acidity are reduced by the addition of Mobil MCP 917 by the rotary bomb oxidation test.

EXAMPLE 4

In order to test the formulations of the present invention in natural ester biodegradable lubricant applications, two lubricants having the following specific components were prepared:

| Additive: | No. 1 | No. 2 |
|---|---|---|
| Lubrizol 7632 (Lubrizol Corp.) | | 88.00 |
| Lubrizol 7640 (Lubrizol Corp.) | 88.00 | |
| Mobil MCP 917 (Mobil Chemical Co.) | 10.00 | 10.00 |
| Irgalube 349 (Ciba Geigy) | 0.30 | 0.30 |
| Lubrizol 859 (Lubrizol Corp.) | 0.10 | 0.10 |
| Irgamet 39 (Ciba Geigy) | 0.10 | 0.10 |
| Irganox L-57 (Ciba Geigy) | 1.00 | 1.00 |
| Irganox L-135 (Ciba Geigy) | 0.50 | 0.50 |
| | 100.00 | 100.00 |

| Example 4 | No. 1 | No. 2 | Mobil EAL 224H |
|---|---|---|---|
| RBOT w. Mobil MCP 917: | | | |
| Hours | 11 hrs. @ 150° C. | 35 min. @ 150° C. | |
| TAN | 14.31 | 59.93 | |
| Oil Appearance | Black oil | Black oil | |
| Copper Appearance | Very clean copper | Clean copper | |

-continued

| | | | |
|---|---|---|---|
| Varnish and Sludge | Light deposit | Moderate sludge | |
| RBOT Without MCP 917 | | | |
| Hours | 8 hrs. @ 150° C. | 20 min. @ 150° C. | |
| TAN | 21.24 | 178 | |
| Oil Appearance | Black oil | Black oil | |
| Copper Appearance | Clean copper | Clean copper | |
| Varnish and Sludge: | Heavy sludge | Heavy sludge | |
| RBOT Without MCP 917 | | | |
| Hours | | | 30 min. @ 150° C. |
| TAN | | | 12.9 |
| Oil Appearance | | | Amber oil |
| Copper Appearance | | | Clean copper |
| Varnish and Sludge: | | | Light deposit |

In this example, oxidation, oil color, copper corrosion, varnish/deposits, and acidity are reduced by the addition of Mobil MCP 917, as determined by the rotary bomb oxidation test.

EXAMPLE 5

In order to test the formulations of the present invention in synthetic ester biodegradable lubricant applications, two lubricants having the following specific components were prepared:

| | Weight % | |
|---|---|---|
| Additive: | No. 1 | No. 2 |
| Mobil MCP 1264 (Mobil Chemical Co.) | 88.00 | |
| Mobil MCP 1186B (Mobil Chemical Co.) | | 88.00 |
| Mobil MCP 917 (Mobil Chemical Co.) | 10.00 | |
| Mobil MCP 968 (Mobil Chemical Co.) | | 10.00 |
| Irgalube 349 (Ciba Geigy) | 0.30 | 0.30 |
| Lubrizol 859 (Lubrizol Corp.) | 0.10 | 0.10 |
| Irgamet 39 (Ciba Geigy) | 0.10 | 0.10 |
| Irganox L-57 (Ciba Geigy) | 1.00 | 1.00 |
| Irganox L-135 (Ciba Geigy) | 0.50 | 0.50 |
| | 100.00 | 100.00 |

| Example 5 | No. 1 | No. 2 |
|---|---|---|
| RBOT w. Mobil MCP 917 or MCP 968: | | |
| Hours | 30 hrs. @ 150° C. | 17 hrs. @ 150° C. |
| TAN | 46.98 | 140 |
| Oil Appearance | Black oil | Black oil, some varnish |
| Copper Appearance | Clean copper | Clean copper |
| Varnish and Sludge | Moderate deposit | Slight sludge on glass |
| RBOT Without MCP 917 or MCP 968: | | |
| Hours | 30 hrs. @ 150° C. | 12.4 hrs. @ 150° C. |
| TAN | 75.98 | 156 |
| Oil Appearance | Black oil | Black oil, some varnish |
| Copper Appearance | Clean copper | Clean copper |
| Varnish and Sludge: | Heavy deposit | Slight sludge on glass |

In this example, oil color, copper corrosion, varnish/deposits, and acidity are reduced by the addition of Mobil MCP 917, a s determined by the rotary bomb oxidation test.

EXAMPLE 6

In order to test the formulations of the present invention in a fire resistant, high flash point lubricant application, two lubricants having the following specific components were prepared:

| Additive: | Weight % No. 1 | Weight % No. 2 |
|---|---|---|
| Emery 2964A (Henkel Corp./Emery Group) | 78.00 | |
| Emery 2918 (Henkel Corp./Emery Group) | | 78.00 |
| Mobil MCP 968 (Mobil Chemical Co.) | 20.00 | 20.00 |
| Irgalube 349 (Ciba Geigy) | 0.30 | 0.30 |
| Lubrizol 859 (Lubrizol Corp.) | 0.10 | 0.10 |
| Irgamet 39 (Ciba Geigy) | 0.10 | 0.10 |
| Irganox L-57 (Ciba Geigy) | 1.00 | 1.00 |
| Irganox L-135 (Ciba Geigy) | 0.50 | 0.50 |
| | 100.00 | 100.00 |

| Example 6 | No. 1 | No. 2 |
|---|---|---|
| RBOT w. Mobil 968: | | |
| Hours | 7 hrs. 45 min. @ 275 | 30 hrs. @ 275° F. |
| TAN | 18.0 | N/A |
| Oil Appearance | Black oil | Black oil |
| Copper Appearance | Clean copper | Clean copper |
| Varnish and Sludge | Moderate sludge | Light sludge |
| RBOT Without MCP 968: | | |
| Hours | 3 hrs. 15 min. @ 275° F. | 30 hrs. @ 275° F. |
| TAN | 22.86 | N/A |
| Oil Appearance | Black, cloudy oil | Black oil |
| Copper Appearance | Clean copper | Clean copper |
| Varnish and Sludge: | Moderate sludge | Light sludge |
| Flash Point (COC) | 600° F. | 520° F. |

A typical formulation of a grease is disclosed below:

EXAMPLE 7

| Additive | Weight % |
|---|---|
| Base Fluid: | |
| Emery 2918 (Henkel Corp./Emery Group) | 68.00 |
| Mobil MCP 917 (Mobil Chemical Co.) | 30.00 |
| Irgalube 349 (Ciba Geigy) | 0.30 |
| Lubrizol 859 (Lubrizol Corp.) | 0.10 |
| Irgamet 39 (Ciba Geigy) | 0.10 |
| Irganox L-57 (Ciba Geigy) | 1.00 |
| Irganox L-135 (Ciba Geigy) | 0.50 |
| | 100.00 |
| Thickener: | |
| Polyurea, Lithium Complex, or Clay | 8–10 percent |

The above base fluid was blended with 5% polyurea thickener to form a semi-fluid grease in order to determine its high temperature performance relative to a clay thickened ester based grease. After 24 hours at 450° F., the grease of the invention was soft while the standard day thickened grease was extremely hard. Results indicate high temperature performance similar to the chain lubricants of this invention.

The grease lubricant of the present invention can be used in a wide variety of applications including general lubrication and in any application where grease is employed. Particularly, the present invention can be used in high speed bearings, electric motor bearings, high temperature bearings, and sealed-for-life bearings where extremely long lubricant life and resistance to varnishing is desired. In high temperature trolley wheel bearings, the present invention provides a grease with extremely low volatility and resistance to deposit formation. These applications are particularly subject to oxidation and therefore require a lubricant that is oxidation resistant.

Thus, the lubricant formulation of the present formulation possesses the versatility and beneficial characteristics of an ester lubricant, but at the same time possesses the beneficial characteristics of the alkylated aromatic lubricants. This permits the lubricants of the present invention to be used in an extremely wide variety of different applications and to outperform the ester lubricants and alkylated aromatic lubricants. Although Applicant has described the present invention, along with the best mode of practicing the present invention currently known, the invention itself should only be defined by the appended claims wherein we claim:

1. A lubricant composition comprising 1 to 70% of a polyaromatic lubricant having a viscosity greater than 25 cSt at 40° C., said aromatic lubricant selected from the group consisting of alkyl polyaromatic lubricant and alkoxy polyaromatic lubricants; and 30 to about 99% by weight of an ester lubricant.

2. The lubricant composition claimed in claim 1 wherein said aromatic lubricant is selected from the group consisting of alkylated naphthenic lubricants and alkoxylated naphthenic lubricants.

3. The lubricant composition claimed in claim 1 wherein said ester lubricant is a polyester.

4. The lubricant composition claimed in claim 2 comprising 5 to about 40% by weight of said polyaromatic lubricant.

5. The lubricant composition claimed in claim 1 further comprising a thickening agent.

6. The lubricant composition claimed in claim 5 wherein said thickening agent is selected from the group consisting of polyurea, modified clay and soap thickeners.

7. The lubricant composition claimed in claim 1 wherein said aromatic lubricant has a viscosity of 75 to 220 cSt at 40° C. providing enhanced thermal stability and reduced volatility.

8. The lubricant composition claimed in claim 1 wherein said ester is selected from the group consisting of C5–C18 adipate esters, C5–C18 azelate esters, C3–C22 trimethylol propane esters, C3–C22 pentaerythritol esters, C3–C22 dipentaerythritol esters, C3–C22 tripentaetythratol esters, C3–C22 neopentylglycol esters, C3–C18 phthalate esters, C3–C18 trimellitate esters, and C3–C22 esters of C36 dimeracid.

9. The lubricant composition claimed in claim 1 wherein said ester is selected from the group consisting of natural seed oil esters or modified seed ester oils.

10. The lubricant composition claimed in claim 2 wherein said aromatic lubricant is selected from the group consisting of C5–C22 alkylnaphthenic lubricants and C5–C22 alkoxynaphthenic lubricants.

11. The lubricant composition claimed in claim 9 wherein said aromatic lubricant comprises C16 monoalkylated naphthalene.

12. The lubricant composition claimed in claim 1 wherein said aromatic lubricant has a viscosity greater than of 25 to 115 cSt at 40° C. providing enhanced oxidation resistance, varnish/deposit control, and corrosion inhibition.

13. The lubricant composition claimed in claim 1 wherein said lubricant composition is a turbine lubricant, and wherein said aromatic lubricant has a viscosity of greater than 25 to 40 cSt at 40° C.

14. The lubricant composition claimed in claim 1 further including additive comprising a succinimide in combination with polymerized dihydroquinoline and a borate.

15. A method of lubricating moving parts of machinery which are heated to greater than 350° F. comprising applying to said moving parts an effective amount of the lubricant claimed in claim 7.

16. A method of lubricating moving parts of machinery selected from the group consisting of compressors, hydraulics and gears and comprising applying to moving parts of said machinery an effective amount of the lubricant claimed in claim 1.

17. A method of lubricating moving parts of machinery comprising applying to moving parts of said machinery an effective amount of the lubricant claimed in claim 1 in the absence of a refrigerant.

* * * * *